US010006208B2

(12) United States Patent
Williams et al.

(10) Patent No.: US 10,006,208 B2
(45) Date of Patent: Jun. 26, 2018

(54) BUILDING CLADDING INSTALLATION SYSTEM

(71) Applicants: John M. Williams, Wells, VT (US); Robert B. Williams, Poultney, VT (US)

(72) Inventors: John M. Williams, Wells, VT (US); Robert B. Williams, Poultney, VT (US)

( * ) Notice: Subject to any disclaimer, the term of this patent is extended or adjusted under 35 U.S.C. 154(b) by 0 days. days.

(21) Appl. No.: 15/698,609

(22) Filed: Sep. 7, 2017

(65) Prior Publication Data

US 2018/0080230 A1 Mar. 22, 2018

Related U.S. Application Data

(60) Provisional application No. 62/495,659, filed on Sep. 19, 2016.

(51) Int. Cl.
*E04F 13/08* (2006.01)

(52) U.S. Cl.
CPC ..... *E04F 13/081* (2013.01)

(58) Field of Classification Search
CPC ..... E04F 13/081; E04F 13/0864
See application file for complete search history.

(56) References Cited

U.S. PATENT DOCUMENTS 4,899,459 A * 2/1990 Taggart ..... E04F 13/0864 33/646
5,564,245 A * 10/1996 Rademacher ..... E04F 13/0864 52/520
9,359,771 B1 * 6/2016 Delforte ..... E04F 13/0882

* cited by examiner

*Primary Examiner* — Patrick J Maestri
(74) *Attorney, Agent, or Firm* — Lawrence J. Shurupoff

(57) ABSTRACT

Elongated mounting strips are provided with a series of evenly spaced apart tile fasteners. The tile fasteners pivot from a storage or shipping position to an installation position where they engage and secure the top edges of cladding tile. Strips of weather resistant material are also mounted to the mounting strips at evenly spaced intervals. The weather resistant strips also pivot from a storage or shipping position to an installation position underlying a joint between a pair of adjacent cladding tiles.

12 Claims, 6 Drawing Sheets

BUILDING CLADDING INSTALLATION SYSTEM

BACKGROUND AND SUMMARY

The exterior surfaces and walls of buildings can be covered and protected from the environment by cladding in the form of panels, tiles, shingles and the like. As used herein, the terms "tile" and "tiles" are intended to include both natural and artificial sheets or slabs of material suitable for use as a cladding or covering over any exterior surface of a building, and particularly over building walls.

In the examples described below, naturally occurring materials such as slate and stone materials are used as representative cladding tiles. However, the cladding installation and mounting assembly described below can be used with any type of tiles to facilitate and expedite the installation of cladding tiles on a building.

A quickly and conveniently installed tile installation system has been developed for mounting cladding tiles to a building without the need for costly skilled labor. That is, prior cladding installation methods required nailing all tiles directly to a building wall. This required a skilled installer to use just the right amount of driving force to drive a nail through a punched or drilled hole in a tile. Too much force resulted in damaged or broken tiles and too little force resulted in loose tiles which could blow away under high winds.

The cladding installation system described below can be installed without the need for nailing tiles to a wall and without the need for punching or drilling nail holes through the cladding tiles. Instead of relying on the use of nails, the cladding system disclosed below uses a series of vertically-spaced, horizontally-elongated mounting strips each preassembled with a series of horizontally spaced tile fasteners.

The tile fasteners are pivotally mounted to the mounting strips so they can be manually rotated into a compact storage or shipping position and manually rotated from the shipping or storage position into an installed position. This can be achieved by a simple twisting or turning movement over an angle of, for example, ninety degrees or less.

The mounting strips can be formed of extruded metal or plastic. However, plastic materials are well suited for this application due to their light weight, low cost and low thermal expansion.

In addition to the tile fasteners, a series of weather barriers or rain guards is pivotally mounted to the mounting strips at spaced intervals. The rain guards can be formed of any thin sheet of weather resistant or waterproof material such as high density polyethylene (HDPE) or roofing underlayment material such as that commonly referred to as "tar paper". The rain guards can be pivoted into a storage or shipping position along with the tile fasteners, and quickly and easily rotated or turned to an installed position with a simple manual twist or turn.

An advantage of the cladding installation system described below is its ability to be installed in separate stages by different installers. While the cladding installation system can be installed by a single installer, the option to separate the installation steps allows for the preassembly of the mounting strips to a building by one installer and the final installation of cladding tiles by a second installer. This not only provides flexibility in the installation process but also can speed up the installation process by using two or more installers working in tandem.

Because the tile fasteners are preassembled on the mounting strips in an indoor manufacturing facility, an installer is not required to mount individual tile fasteners to a building or to a mounting strip or batten. This not only simplifies installation and saves installation time, it also eliminates the bother and aggregation of separating tangled fasteners.

That is, prior fasteners have been carried by installers in a pouch in which the fasteners become tangled and must be untangled by an installer prior to use. Moreover, because the tile fasteners are assembled in a controlled indoor facility, the accuracy of the spacings between the tile fasteners and rain guards is better than that achieved by installers at an outdoor construction site.

The accurate and substantially equal spacings between the tile fasteners results in a symmetrical pattern of installed cladding tiles giving a building an eye pleasing architectural character. The resulting symmetry of the tiles is both artistically and aesthetically pleasing and avoids the unsightly appearance of irregular joints common in other cladding and siding systems.

The cladding installation system disclosed below is more cost effective than other types of building exterior coverings, including artificial planking and stucco. Because slate and stone cladding experiences minimal color fading over time, it maintains its original appearance and color better than artificially colored or dyed plastic planking and plastic siding. Slate and stone cladding also is less susceptible to thermal expansion and contraction than artificial planking and results in a more dimensionally stable and secure cladding.

The lightweight, self-contained preassembled cladding system eliminates the need for measuring and installing tile fasteners on a building, and provides a simple, easy to use, accurate and robust mounting for building cladding tiles As building cladding is typically installed from the bottom of a wall to the top of a wall, prior cladding systems required an installer to manually hold a tile in place over a lower tile while trying to drive a nail into the upper tile. This is cumbersome and time consuming.

In contrast, when using the tile installation system described below, an installer needs only to pivot or rotate a preinstalled fastener about ninety degrees or less to engage and hold the upper edge of a tile in an installed position. No nailing, clipping or other fastening is required to initially hold a tile in place during its installation. This greatly facilitates and expedites the installation of tiles on a building. Moreover, the tile installation system described below can be installed starting from either the top or bottom of a wall thereby offering greater flexibility and choice in the installation process.

BRIEF DESCRIPTION OF THE DRAWINGS

In the drawings.

In the various views of the drawings, like reference numbers represent like of similar parts.

DESCRIPTION OF REPRESENTATIVE EMBODIMENTS

Figure 1:
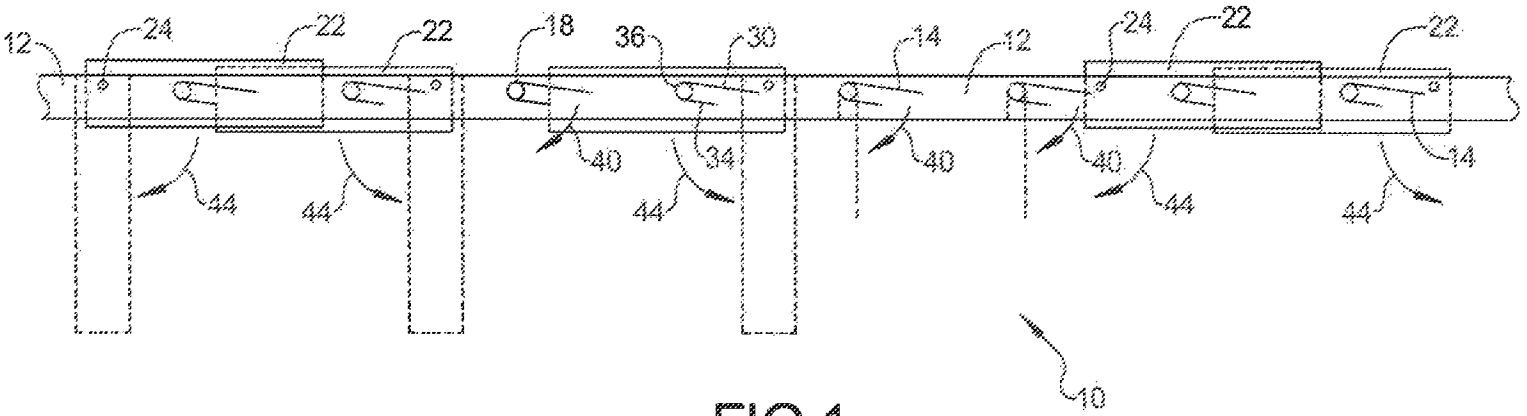
FIG. 1 is a schematic front view of a cladding tile installation system constructed in accordance with this disclosure and showing the tile installation system in a storage or shipping configuration in solid lines and in an installed configuration in dashed lines.

A tile installation system 10 is shown in FIG. 1 in a compact folded storage or shipping configuration. This shipping configuration allows for more compact, efficient and low cost packaging, storing, shipping and transportation to a distributor, retailer and/or job site. The system 10 includes an elongated mounting strip 12 formed of, for example, extruded plastic or plastic sheet material. An evenly spaced series of tile fasteners 14 is pivotally mounted to the mounting strip 12. While any rotatable or pivotal connection can be used, a simple, expedient and low cost connection can be provided with a rivet 18, as described more fully below.

The tile fasteners 14 can be formed of a weather resistant wire material such as stainless steel, although any other resilient material can be used. The tile fasteners 14 are designed to flex outwardly and over the upper edge of a tile to provide a compressive spring retention force on the tile, as described below.

In one example, the pivot axis of each tile fastener 14 can be spaced apart by about ten inches. An evenly spaced series of weather resistant strips or sheets of, for example, plastic material such as a thin flexible sheet of high density polyethylene (HDPE), is also pivotally mounted to the mounting strip 12. These strips 22 will be referred to hereafter as "rain guards". While any rotatable or pivoting connection can be used, a simple, expedient and low cost pivotable connection can be provided with a rivet 24, similar to the rivets 18.

The pivot axes of the rain guards 22 are located midway between the pivot axes of a pair of adjacent tile fasteners 14 and are spaced apart at about twice the spacings between the pivot axes of the tile fasteners 14. In this example, a pair of tile fasteners 14 is provided between each adjacent pair of rain guards 22 to grip and secure each full sized tile, as discussed below.

In the above example where the pivot axes of the tile fasteners are spaced apart by about ten inches, the pivot axes of the rain guards 22 are spaced apart by about twenty inches. This spacing provides two tile fasteners 14 for supporting each tile having a length of about twenty inches and a height of about fourteen inches. In this case each tile fastener 14 is positioned about five inches from the closest side of an underlying tile.

Also with this spacing, a rain guard 22 is positioned or centered under the adjoining sides of a pair of twenty inch length tiles. In this example, the rain guard 22 can have a width of about three inches and a length of about thirteen inches. The rain guard 22 protects the underlying building material from exposure to rain, sun, wind and harsh weather below and between the small openings or joints formed between the confronting sides of each pair of adjoining tiles, as shown and described more fully below.

As further seen in FIG. 1, the tile fasteners 14 can be formed with a long arm 30 and a short arm 34. The tile fasteners 14 can be formed of wire with a "U"-shaped elbow or bend 36 interconnecting the long arm 30 and the short arm 34. It is also possible to form the tile fasteners 14 from thin sheets of metal shaped as spring clips which resiliently engage the tiles, as described below. As indicated by directional arrows 40, the tile fasteners 14 can be pivoted or rotated from their upper storage or shipping position shown in solid lines, to their lower or installed positions shown in dashed lines.

Likewise, as further seen in FIG. 1, the rain guards 22 can be pivoted or rotated from their upper storage or shipping positions shown in solid lines to their lower or installed position shown in dashed lines, as indicated by direction arrows 44. An adjacent pair of rain guards 22 can have their lower or free end portions overlapped in their storage positions prior to rotation into their installed positions.

Figure 2:
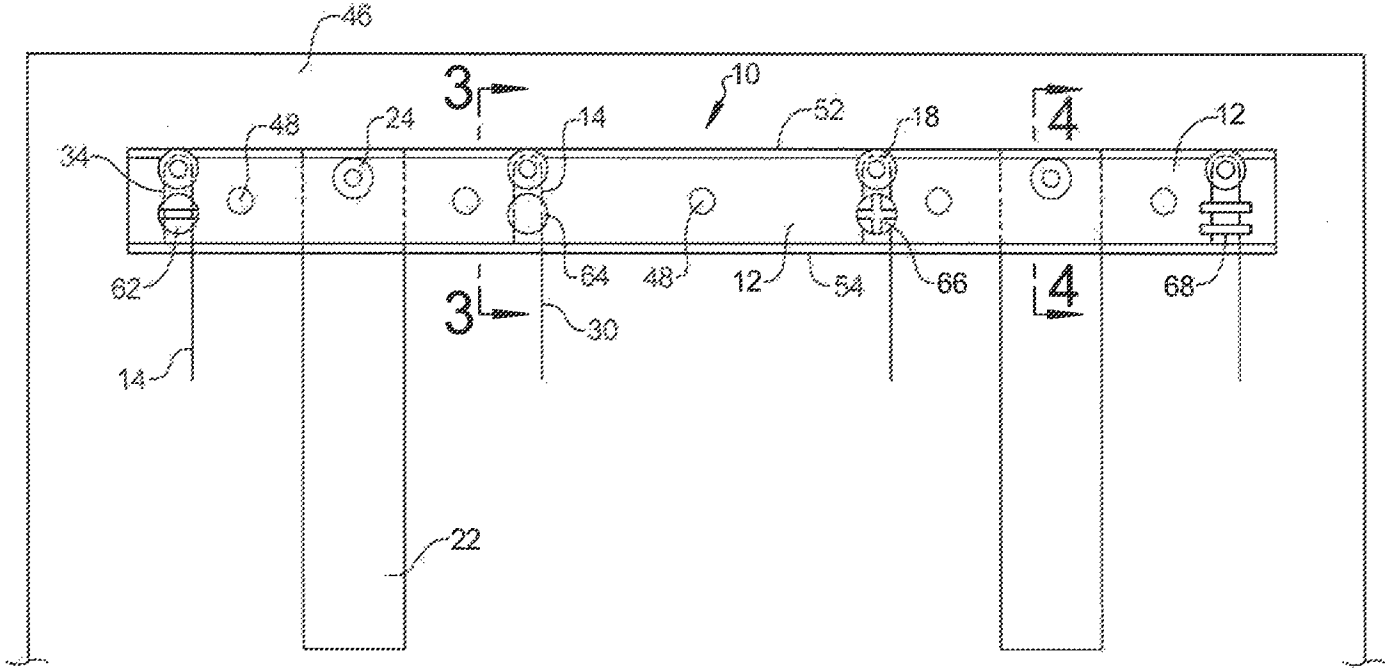
FIG. 2 is an enlarged view of a portion of the tile installation system of FIG. 1, shown nailed to a building with rain guards and tile fasteners rotated downwardly into their installation positions.

A more detailed view of a tile installation system 10 is shown in FIG. 2 where the mounting strip 12 is shown attached to an outer surface of a wall, such as to an outer surface of a building 46. The mounting strip 12 can be attached to the building 46 with any suitable fasteners, such as nails 48. In FIG. 2, the tile fasteners 14 are shown rotated and lowered into their installation positions as are the rain guards 22. The mounting strip 12 is typically positioned to extend horizontally across the building 46.

As shown in FIG. 2, the mounting strip 12 includes an upper flange 52 and a lower flange 54. These flanges strengthen and stiffen the mounting strip 12 and serve as frictional engagement surfaces for assisting an installer in the proper orientation of the tile fasteners 14 in their installed position. That is, when a tile fastener 14 is rotated downwardly from its upper storage position to its lower installed position, the free end or tip 60 (FIG. 3) of the short arm 34 engages and rubs against the lower flange 54 with increasing resistance up to its properly oriented installed vertical position.

Further rotation of the tile fastener 14 past its vertical position results in less frictional resistance between the tip 60 of the short arm 34 and the lower flange 54. In this manner, the installer can easily determine from tactile "feel" the proper orientation of the tile fastener in its installed position. In effect, the rotation and increasing and decreasing resistance to rotation of the short arm 34 against the lower flange 54 acts as an over-center device for aiding an installer in properly positioning the tile fastener in its installed vertical position. Similar sliding frictional loading is simultaneously produced between the elbow 36 and the upper flange 52 to enhance the variable tactile feel experienced by an installer.

As further shown in FIG. 2, once the installation system 10 is attached to a building 46 with, for example, nails 48, the tile fasteners 14 are manually positioned by rotation into their installation positions and then permanently fixed in this position with any suitable mounting fastener. In FIG. 2, different mounting fasteners are shown driven between and against both the long arm 30 and the short arm 34 to clamp the tile fasteners 14 against the mounting strip 12. Mounting fasteners such as a screw 62, nail 64, Phillips head 66 or staples 68 can be used for this purpose.

Figure 3:
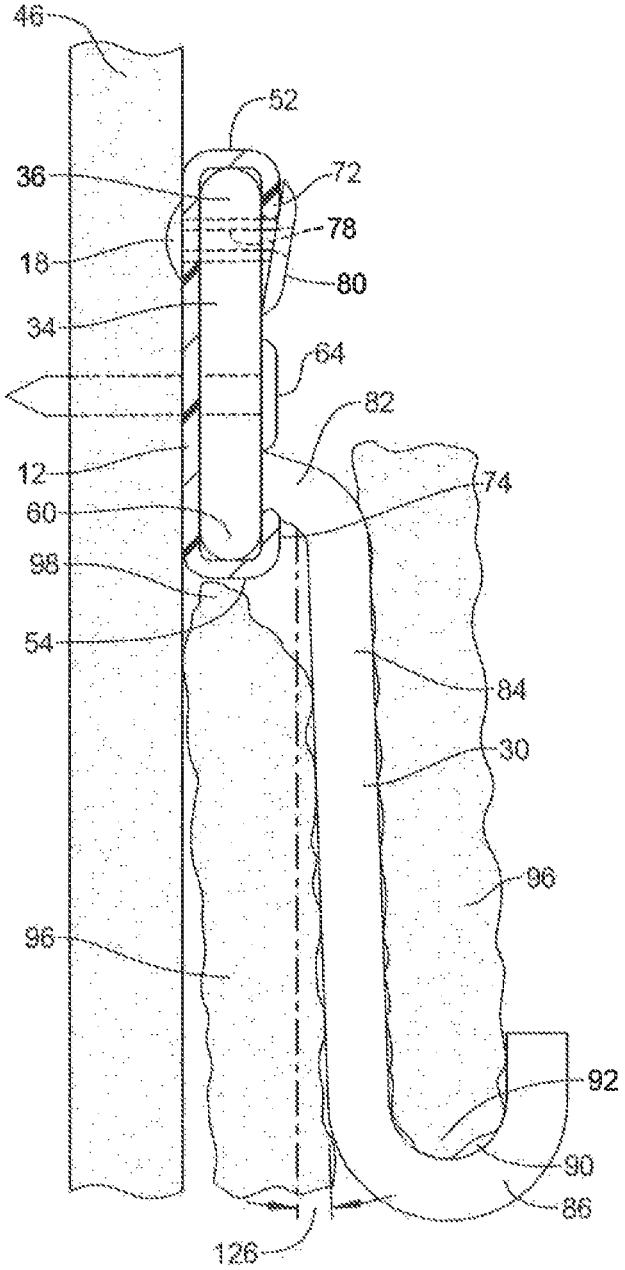
FIG. 3 is an enlarged sectional side view taken along section line 3-3 of FIG. 2 and adding the top and bottom overlapped portions of two tiles as a representative example.

As seen in FIG. 3, a mounting fastener such as a nail 64 is driven through the mounting strip 12 and into the underlying building 46. The nail 64 is driven between the long arm 30 and the short arm 34 so that the head of the nail 64 engages and clamps both arms in proper permanent substantially vertically extending position.

Figure 4:
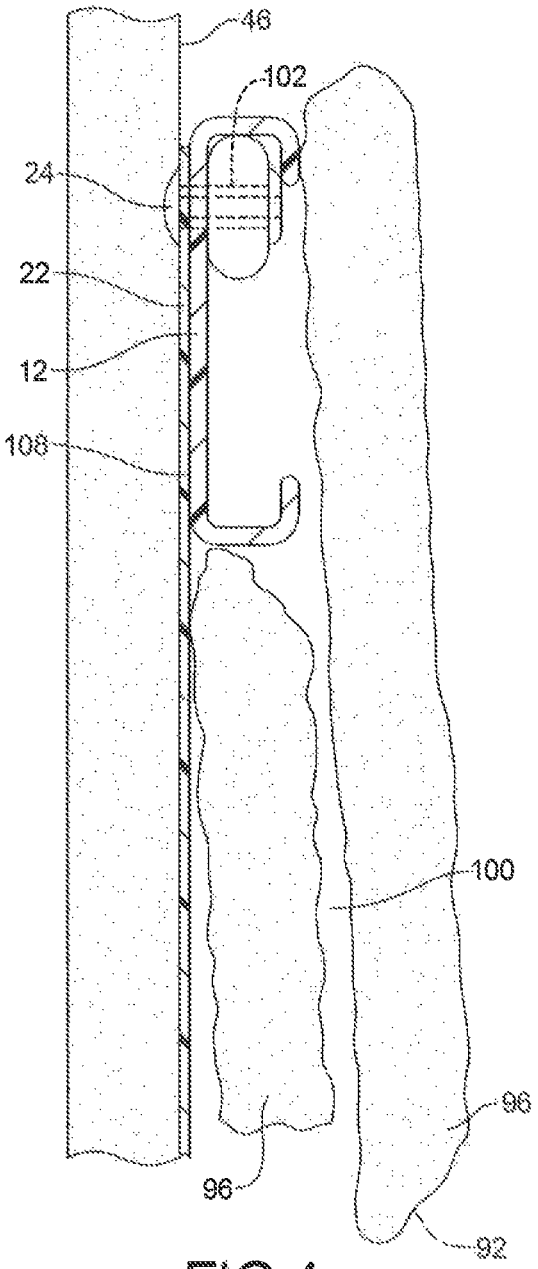
FIG. 4 is an enlarged sectional side view taken along section line 4-4 of FIG. 2 and showing a ventilation space provided between the overlapped portions of two tiles as a representative example.

Additional details of the mounting strip 12 are shown in FIGS. 3 and 4, where the upper flange 52 extends into an upper lip 72 and the lower flange 54 extends into a lower lip 74. These lips form U-shaped horizontal channels that increase the rigidity of the mounting strip 12 and provide additional support for the tile fasteners 14.

That is, as seen in FIGS. 2 and 3, the rivet 18 has a head 80 clamped over the upper lip 72 as well as over both arms 30, 34. The clamping force of the rivet 18 presses the upper lip 72 against the elbow bend 36 of the tile fastener 14 to provide a rotating and sliding frictional contact between the tile fastener 14 and the mounting strip 12. The shaft 78 of the rivet 18 forms the pivot axis of the fastener 14 and serves as a pivot pin.

The long arm 30 of the fastener 14 is shown in FIG. 3 as including an outwardly extending bend portion 82 that extends over the lower lip 74 into an elongated shank portion 84. The shank portion 84 extends into a hook portion 86 bending upwardly and outwardly from the building and outwardly from an underlying tile 96 to form an open mouth position 90.

For the purpose of clarity, in FIG. 3 the lower edge portion 92 of a tile 96 in an upper row of tiles is shown seated within the open mouth portion 90 of the tile fastener 14. The upper edge portion 98 of a tile 96 in a lower row of tiles is shown positioned against or adjacent to the lower flange 54 of the mounting strip 12. The shank portion 84 of the tile fastener 14 is located or sandwiched between the upper edge 98 of the lower tile and the lower edge portion 92 of the upper tile 96.

The shank 84 of the tile fastener 14 as shown in FIG. 3 creates a spacing or ventilation space 100 between the overlapped tiles as shown in FIG. 4. This helps to remove moisture from between the tiles and the building so as to protect the building from damage such as caused by mildew, mold and trapped water. Water vapor can easily pass outwardly from the ventilation spaces through the open joints formed between adjacent pairs of tiles.

Additional details of the rain guard 22 are shown in FIG. 4 where the shaft 102 of the rivet 24 forms a pivot axis and pivot pin for the rain guard 22. As further shown in FIGS. 2 and 4, the rain guards 22 are pivotally secured to the rear surface 108 of the mounting strip 12 with pivoting and sliding clamped connections provided by the rivets 24. As further seen in FIG. 4, the rear surfaces of the rain guards 22 are layered over the outer surface of a building 46 and provide a protective barrier beneath the open spaces or open joints 124 formed between the confronting juxtaposed sides of adjacent tiles 96, as shown in FIG. 5.

Figure 5:
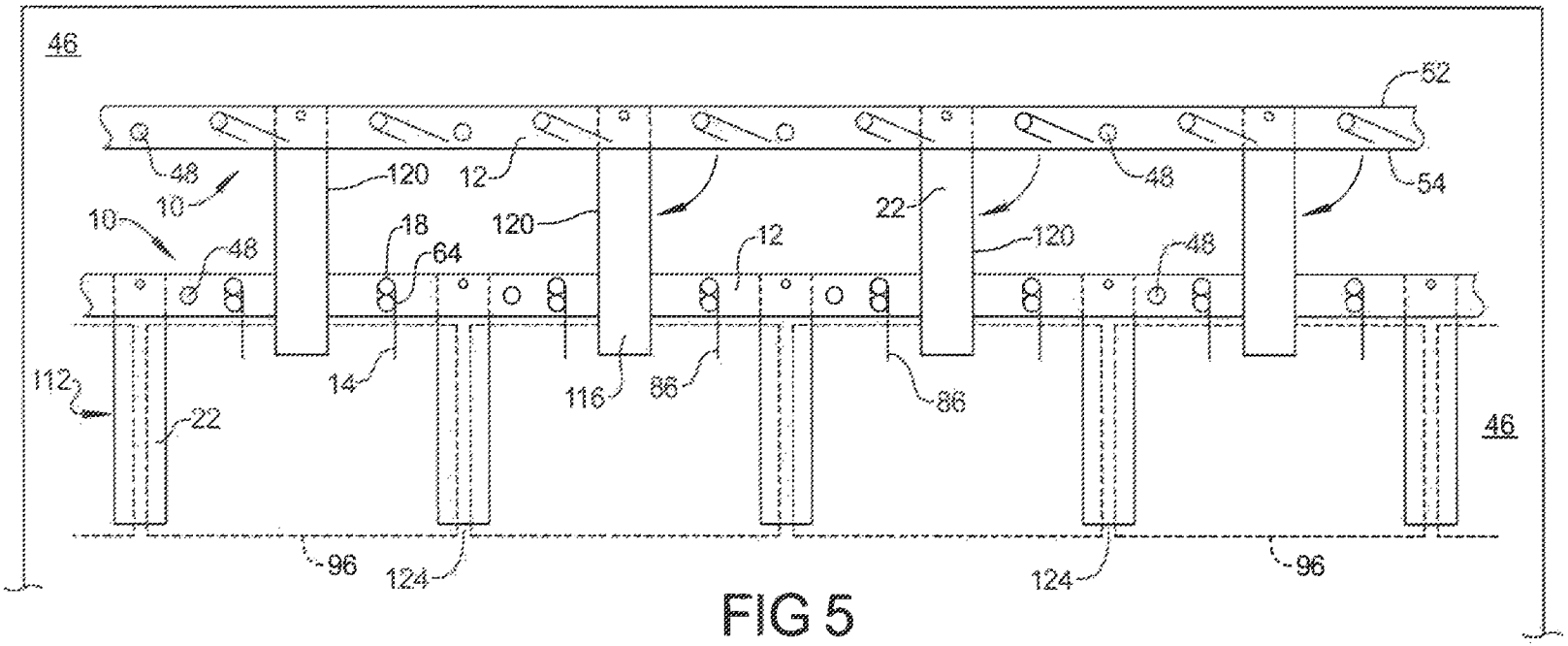
FIG. 5 is a schematic front view of a first row of tiles shown in dashed lines installed on a lower tile installation system, and an upper tile installation system positioned over the first row of tiles.

FIG. 5 shows a representative lower row or course 112 of tiles 96 with the tiles 96 laying on and overlapping the rain guards 22, and with the tiles 96 shown in dashed lines for clarity. As described below in connection with FIG. 6, the lower row 112 of tiles 96 can be held by the hooks of a yet lower tile installation system not shown in FIG. 5. Both tile installation systems 10 in FIG. 5 are shown mounted to a building 46 such as shown in FIG. 2.

As further seen in FIG. 5, the tile fasteners 14 in the lower tile installation system 10 are shown in their vertical installed positions and the tile fasteners 14 in the upper tile installation system are shown in a shipping, handling and storage position aligned substantially completely over the mounting strip 12. Each tile installation system 10 is much easier to handle and initially position against a wall during installation when in a compact shipping and storage position. In this compact position, the tile fasteners 14 and rain guards 22 are folded against the mounting strip 12 and are less likely to become tangled with other tile installation systems, job site materials and installer's clothing.

An example of the positioning and mounting pattern of one tile installation system 10 above another tile installation system 10 is further depicted in FIG. 5. The upper tile installation system 10 can represent a topmost tile installation system 10 shown positioned over and above a lower tile installation system 10 and secured to the surface of a building 46 with nails 48. The rain guards 22 on the upper tile installation system 10 are shown rotated down into their vertical installation positions. The lower free end portions 116 of the rain guards 22 on the upper tile installation system 10 are shown overlapping the mounting strip 12 on the lower tile installation system 10.

To continue installation of tiles on the building 46 in FIG. 5, an installer will place a tile 96 (not shown) into the hooks 86 of two adjacent fasteners 14 on the lower mounting strip 12 and over the side edge portions 120 of two adjacent rain guards 22 on the upper tile installation system 10. The installer will offset this upper tile 96 so that it is centered over a joint 124 between two tiles 96 in the lower row 112 of tiles 96.

The installer will then press or push the tile 96 towards the building with one hand and rotate two tile fasteners 14 on the upper tile installation system 10 outwardly from the building 46 and downwardly into spring-biased contact with the upper edge portion 98 (FIG. 3) of the tile 96. The secures the tile 96 in an installed position held under the spring-biased compression produced by resilient outward deflection of the two tile fasteners 14. This deflection is shown in FIG. 3 where the shank portion 84 of the tile fastener 14 is shown deflected outwardly over the arc 126.

Figure 6:
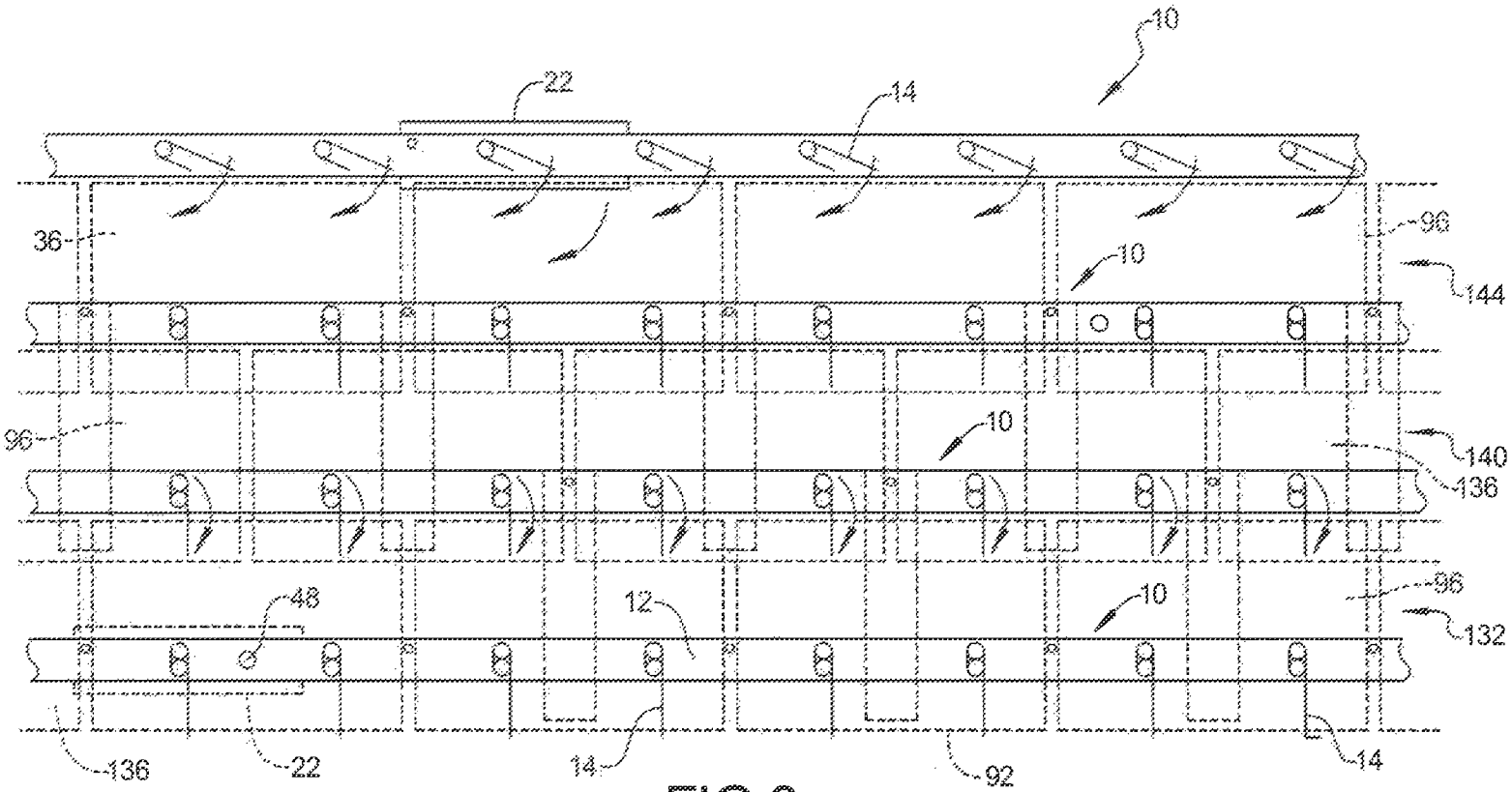
FIG. 6 is a schematic front view of first and second rows of tiles shown in dashed lines installed on a building with first, second and third tile installation systems, and a third upper row of tiles shown in dashed lines and positioned under a fourth top tile installation system prior to rotation of the tile fasteners and rain guards on the fourth top tile installation system. For clarity, only one rain guard is shown on the top and bottom tile installation systems.

The tile installation process outlined above is more fully described in conjunction with FIG. 6 where a first row 132 of tiles 96 is shown in dashed lines with the lower edges 92 of the tiles 96 held in an evenly spaced apart series of tile fasteners 14. The tile installation system 10 in this first or bottom row 132 does not require rain guards 22. In this case, the rain guards 22 can be removed or, as shown in FIG. 6, simply nailed to a building in their storage position with a nail 48. This is represented by the horizontally-extending rain guard 22 shown in dashed lines in the first row 132 nailed in place with a nail 48. Only one rain guard 22 is shown for clarity.

In order to produce a pleasing offset or staggered pattern of tiles, a half-length tile 136, such as a ten inch long tile in the above example, can be used to start the first row 132. Full length tiles can subsequently be mounted along the first row 132.

As noted above, all of the tile installation systems 10 can be attached to a building prior to installing any tiles. Alternatively, an installer can attach the first or bottom tile installation system 10 and the next higher or upper tile installation system 10 to a building and then rotate the rain guards 22 on the upper tile installation system 10 downwardly over the mounting strip 12 on the lower tile installation system 10. The installer then places a first tile 96 or half tile 136 into the respective hooks or hook 86 of one or more tile fasteners 14 on the lower tile installation system 10. In the case of a full length tile 96, the installer centers the tile between two adjacent rain guards 11.

While holding this first tile 96 in place along the building with one hand, with the tile overlapping about one half of one or more adjacent rain guards 22, the installer then secures the tile in its installed position by rotating one or more fasteners 14 in the next adjacent upper row over and against the upper edge portion 98 of the tile 96. As no nailing is required, the installation process is greatly simplified and the time required for tile installation is greatly reduced. The installer repeats this process for each subsequent tile 96 in the first row 132.

The installer then installs a third tile installation system 10 over the second tile installation system 10 and repeats the installation process for a second row 140 of tiles 96 in the same manner as described for the first row 132 of tile 96. This process repeats itself until the top row of tiles is installed.

As further shown in FIG. 6, a third row 144 of tiles 96 is shown prior to engagement and contact with the rain guards 22 and the tile fasteners 14. For clarity, only one rain guard 22 is shown in its storage position. The rain guards 22 are rotated downwardly prior to placement of tiles 96 under the fourth installation system 10 and into the tile fasteners 14 in third tile installation system 10. The tile fasteners 14 are rotated downwardly after the tiles 96 have been placed into the tile fasteners in the adjacent lower third tile installation system 10.

The topmost row of tiles 96 (not shown) can be secured with individually installed spring clips, or held in place in a traditional fashion by nailing through holes punched in the topmost row of tiles. The topmost row of tiles can also be secured with the lower portion of the head of a nail driven onto the top edges of the tiles 96.

It will be appreciated by those skilled in the art that the tile installation system described above is merely representative of the many possible embodiments of the disclosure and that the scope of the disclosure and the following claims should not be limited thereto. For example, instead of providing pivoting connections between the mounting strip 12 and the tile fasteners 14, other movable connections are possible such as sliding connections allowing the tile fasteners to slide vertically up and down under the frictional retention force of a clamping member, such as the frictional clamping force of a rivet 18.

Those skilled in the art can now appreciate from the foregoing description that the teachings of the disclosure can be implemented in a variety of forms. While the disclosure includes particular examples, the scope of the disclosure and following claims should not be so limited since other modifications will become apparent to the skilled practitioner upon a study of the drawings, the specification and the following claims.

What is claimed is:

1. A building cladding system, comprising:

a first elongated mounting strip;

a tile fastener pivotally mounted on said elongated mounting strip;

said tile fastener capable of pivoting about a pivot axis from an upper storage position to a lower installed position; and a sheet of weather resistant material pivotally mounted on said elongated mounting strip and capable of pivoting from an upper storage position to a lower installed position.

2. The cladding system of claim 1, further comprising a pivot pin provided on said elongated mounting strip and wherein said tile fastener pivots around said pivot pin.

3. The cladding system of claim 2, wherein said pivot pin comprises a portion of a rivet.

4. The cladding system of claim 1, wherein said sheet of weather resistant material is mounted on a rear surface portion of said elongated mounting strip.

5. The cladding system of claim 1, wherein said first elongated mounting strip is mounted on a building and further comprising a second elongated mounting strip disposed below said first elongated mounting strip, and wherein said sheet of weather resistant material overlaps said second elongated mounting strip.

6. The cladding system of claim 1, further comprising a tile having an upper portion extending under said die fastener and wherein said tile fastener comprises a lower hook portion extending outwardly from a front surface portion of said tile.

7. The cladding system of claim 1, further comprising a mounting fastener extending through said first elongated mounting strip and securing said first elongated mounting strip to a wall and clamping said tile fastener in said lower installed position to said first elongated mounting strip.

8. The cladding system of claim 1, wherein said first elongated mounting strip comprises an upper channel and a lower channel, and wherein said tile fastener frictionally engages said upper and lower channels when in said lower installed position.

9. The cladding system of claim 1, further comprising a series of equally spaced apart sheets of weather resistant material coupled to said first elongated mounting strip and a series of equally spaced apart tile fasteners coupled to said first elongated mounting strip.

10. The cladding system of claim 9, wherein two of said equally spaced apart tile fasteners are provided between an adjacent pair said equally spaced apart sheets of weather resistant material.

11. The cladding system of claim 9, wherein spacings between adjacent pairs of said equally spaced apart weather resistant material are greater than spacings between adjacent pairs of said equally spaced apart tile fasteners.

12. The cladding system of claim 9, wherein said series of spaced apart sheets of weather resistant material extends substantially horizontally along said first elongated mounting strip and said series of equally spaced apart tile fasteners is aligned over said first elongated mounting strip to define a compact configuration for shipping and handling.

* * * * *